US007575490B1

(12) United States Patent
Angel et al.

(10) Patent No.: US 7,575,490 B1
(45) Date of Patent: Aug. 18, 2009

(54) PASSIVE AIR INDUCTION SYSTEM FOR BOATS

(75) Inventors: Bruce A. Angel, New Bern, NC (US); Glenn Lyle Spain, New Bern, NC (US)

(73) Assignee: Brunswick Corporation, Lake Forest, IL (US)

( * ) Notice: Subject to any disclaimer, the term of this patent is extended or adjusted under 35 U.S.C. 154(b) by 4 days.

(21) Appl. No.: 11/674,310

(22) Filed: Feb. 13, 2007

Related U.S. Application Data

(60) Provisional application No. 60/766,803, filed on Feb. 13, 2006.

(51) Int. Cl.
*B63H 1/18* (2006.01)

(52) U.S. Cl. ..... 440/66

(58) Field of Classification Search ..... 114/288, 114/289; 440/66, 69
See application file for complete search history.

(56) References Cited

U.S. PATENT DOCUMENTS 4,135,469 A * 1/1979 Rimppi et al. ..... 440/66
4,689,026 A 8/1987 Small
5,957,078 A * 9/1999 Van Tassel ..... 114/288
6,045,420 A 4/2000 Small et al.
6,193,573 B1 2/2001 Small
6,213,824 B1 4/2001 Small
6,406,341 B1 6/2002 Morejohn

* cited by examiner

*Primary Examiner*—Stephen Avila
(74) *Attorney, Agent, or Firm*—Malin Haley DiMaggio Bowen & Lhota, P.A.

(57) ABSTRACT

A passive air induction system for boats that includes a wedge member and air induction tubes. The system is installed within the propeller tunnel of high-speed planing vessels to reduce or eliminate noise and vibration caused by cavitation vortices created by rotation of the propeller blades. The air induction tubes include air inlets that receive ambient air, which is delivered to the wedge member to be released from a plurality of distribution slots on the wedge member as air bubbles. The air bubbles released from the distribution slots provide a cushioning effect against contact between the cavitation vortices and the vessel hull, thereby reducing vibration and noise that has been heretofore common at high speeds in planing vessels.

9 Claims, 4 Drawing Sheets

PASSIVE AIR INDUCTION SYSTEM FOR BOATS

BACKGROUND OF THE INVENTION

1. Field of the Invention

The present invention relates generally to passive air induction systems, and more particularly to advanced marine vessel tunnel designs incorporating air induction tubes and distribution slots about the perimeter of the tunnel for marine propulsion systems.

2. Description of Related Art

During rotation of a boat propeller, the hull bottom of the vessel is impacted by energy in the form of shock waves due to the phenomenon referred to as tip cavitation. Cavitation occurs when spiraling low-pressure cavitation voids (vortices) are created by each blade of the propeller during rotation. As these voids migrate to a zone of higher pressure the cavity suddenly collapse leading to a violent "implosion." This "implosion" produces noise and erratic vibration in the vicinity of the propeller that propagates into the hull structure and eventually onto the boat decks and upper structures of a vessel. As propeller loading increases to meet the demands of heavier boats and increased horsepower these cavitation voids increase in size, the implosion becomes more violent, and thus, the impact on vibration becomes more significant.

U.S. Pat. No. 6,406,341, issued to Morejohn on Jun. 18, 2002, discloses a shallow draft boat hull which incorporates a vent tube in an angled tunnel for the purpose of creating a low pressure area, and dissipating air bubbles in the tunnel. Air bubbles are sucked into a recess and travel upwardly through a tube to be exhausted behind the transom.

U.S. Pat. No. 6,213,824, issued to Small on Apr. 10, 2001, U.S. Pat. No. 6,193,573, issued to Small on Feb. 27, 2001, and U.S. Pat. No. 6,045,420, issued to Small et al., on Apr. 4, 2000, teach a system of hull design, which incorporates centrally placed air induction plenums having planar walls running longitudinally along a section of the hull. Air is introduced into adjacent tunnels which house struts and propellers. The designs are based on critical angular and area formulas for attempted linearization of the relationship between static and dynamic water levels, vessel velocity and engine revolutions per minute.

U.S. Pat. No. 5,957,078, issued to Van Tassel on Sep. 28, 1999, discloses a marine propulsion system and hull design, which includes air ducts, air valves or a combination of both, to introduce air in the propeller tunnel, before the propeller itself. This design is specifically for the purpose of controlling the level of water in the tunnel to optimize the performance of surface-piercing propellers.

The prior art, however, fails either alone or in combination with other references, to teach or suggest the instant engineering designs for an advanced arcuate or semi-circular boat tunnel design incorporating air induction tubes and a complementary curved slot distribution wedge with air outlets, nor any similar or related structure, which was designed for creating a layer of air to absorb energy or shock waves caused by cavitation. The prior art does not disclose or illustrate the components of the instant invention, and likewise does not address the particular problems solved with this marine propulsion system.

SUMMARY OF THE INVENTION

The passive air induction system comprises an innovative engineering design for marine vessel tunnel designs, which are the tunnels housing the drive shaft and propeller mounting structure, struts, and/or rudder assemblies of a vessel. The instant invention comprises in one embodiment a semi-circular tunnel design incorporating air induction channels and the complementary curved distribution channel or chamber with orifices constituting air outlets, and any similar or related structure, for creating a layer of air to absorb energy or shock waves caused by cavitation.

While the vessel is moving, this passive air induction system provides a small layer of compressible air between the hull bottom and the propeller wake developed in advanced tunnel designs found on shallow draft, high speed planing vessels. This compressible layer of air is capable of absorbing and thus reducing the energy (shock waves) exerted against the hull bottom due to the phenomenon referred to as tip cavitation which is caused by low-pressure cavitation voids (vortices) created by each blade of the propeller during rotation. Since this system is not active until the vessel is on plane the slow vessel wake and steering performance are unaffected.

The required air for this system is drawn in through induction channels or tubes which run longitudinally from the transom of the vessel to the distribution orifices. These orifices are distributed evenly around the semi-circular perimeter of the tunnel.

An objective of this invention is to reduce noise and vibration caused by cavitation vortices created by the rotation of the propeller blades of a vessel within the boat propeller tunnel.

Another object of this invention is to provide an efficient, low-energy means for reducing or eliminating noise and vibration caused by cavitation vortices by passively drawing ambient air into a channel installed within the boat propeller tunnel to be exhausted just aft of propeller as air bubbles, thereby forming a cushion against the impact or "implosion" of said cavitation vortices.

An additional objective of this invention is to avoid any impact on slow vessel performance.

In accordance with these and other objects which will become apparent hereinafter, the instant invention will now be described with particular reference to the accompanying drawings.

DETAILED DESCRIPTION

Figure 1:
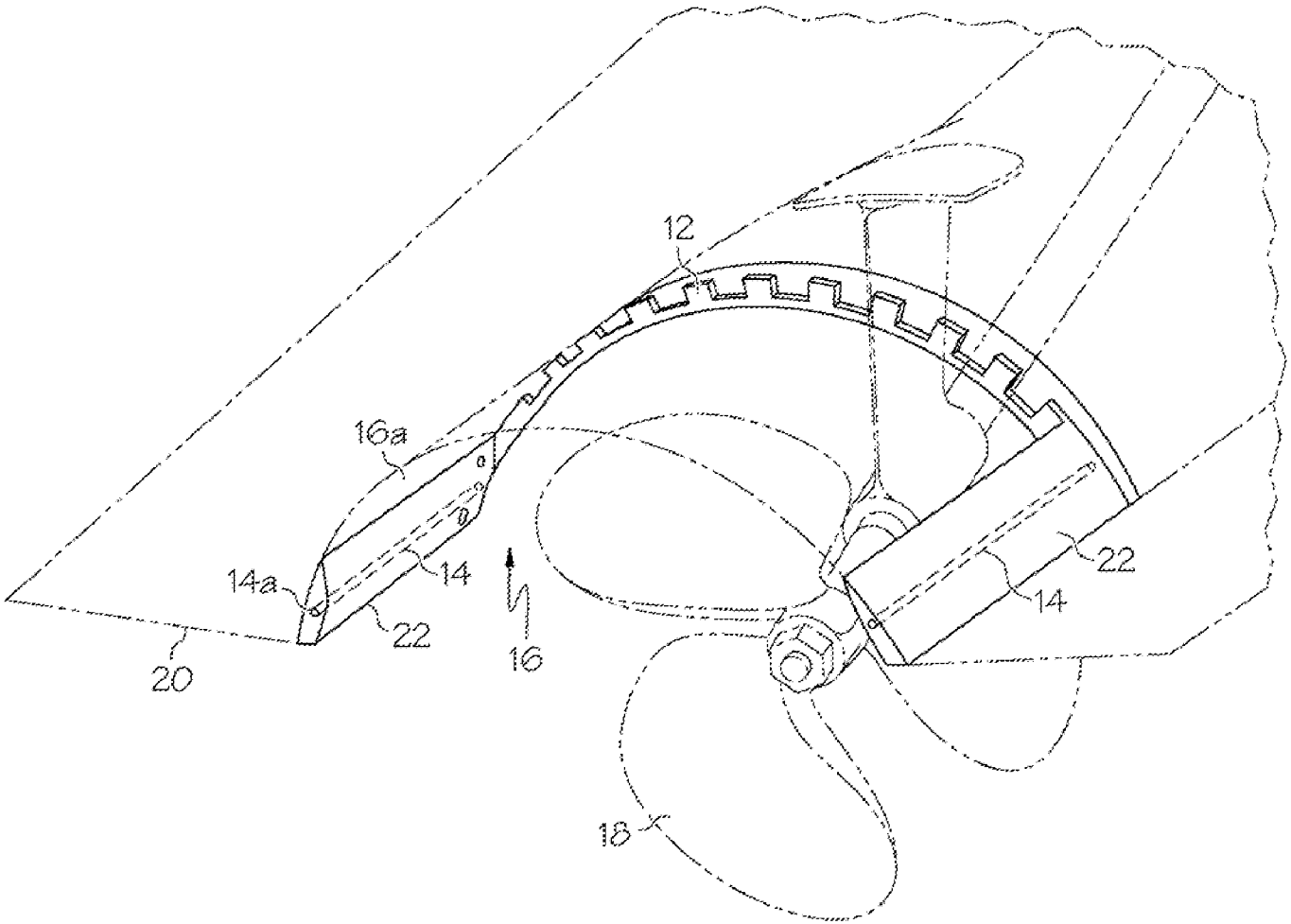
FIG. 1 shows a perspective and isometric view of typical installation of the system in a modern propeller tunnel in conjunction with the induction tubes and distribution slots.
Figure 2:
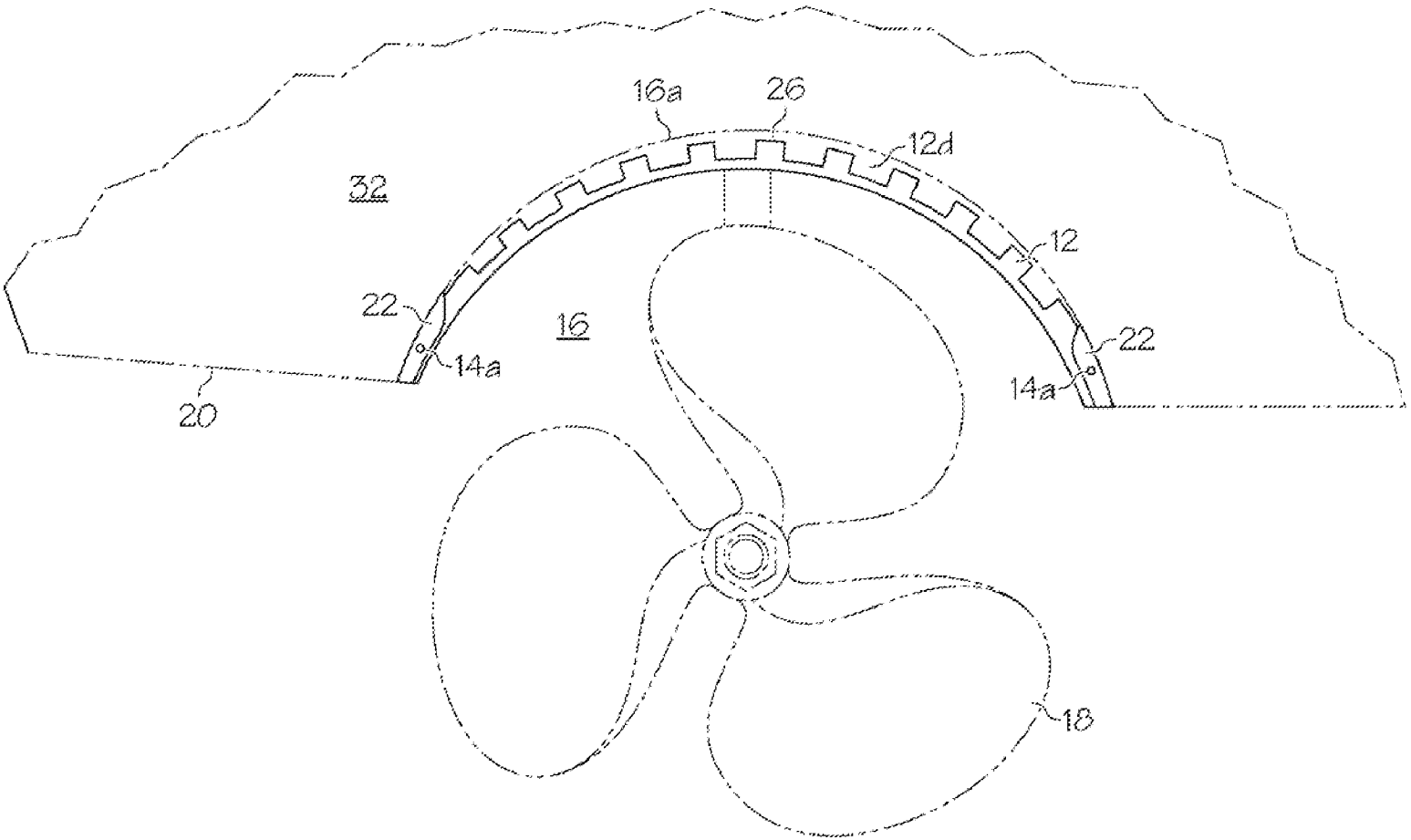
FIG. 2 shows a rear view of the system illustrated in FIG. 1.
Figures 3A, 3B:
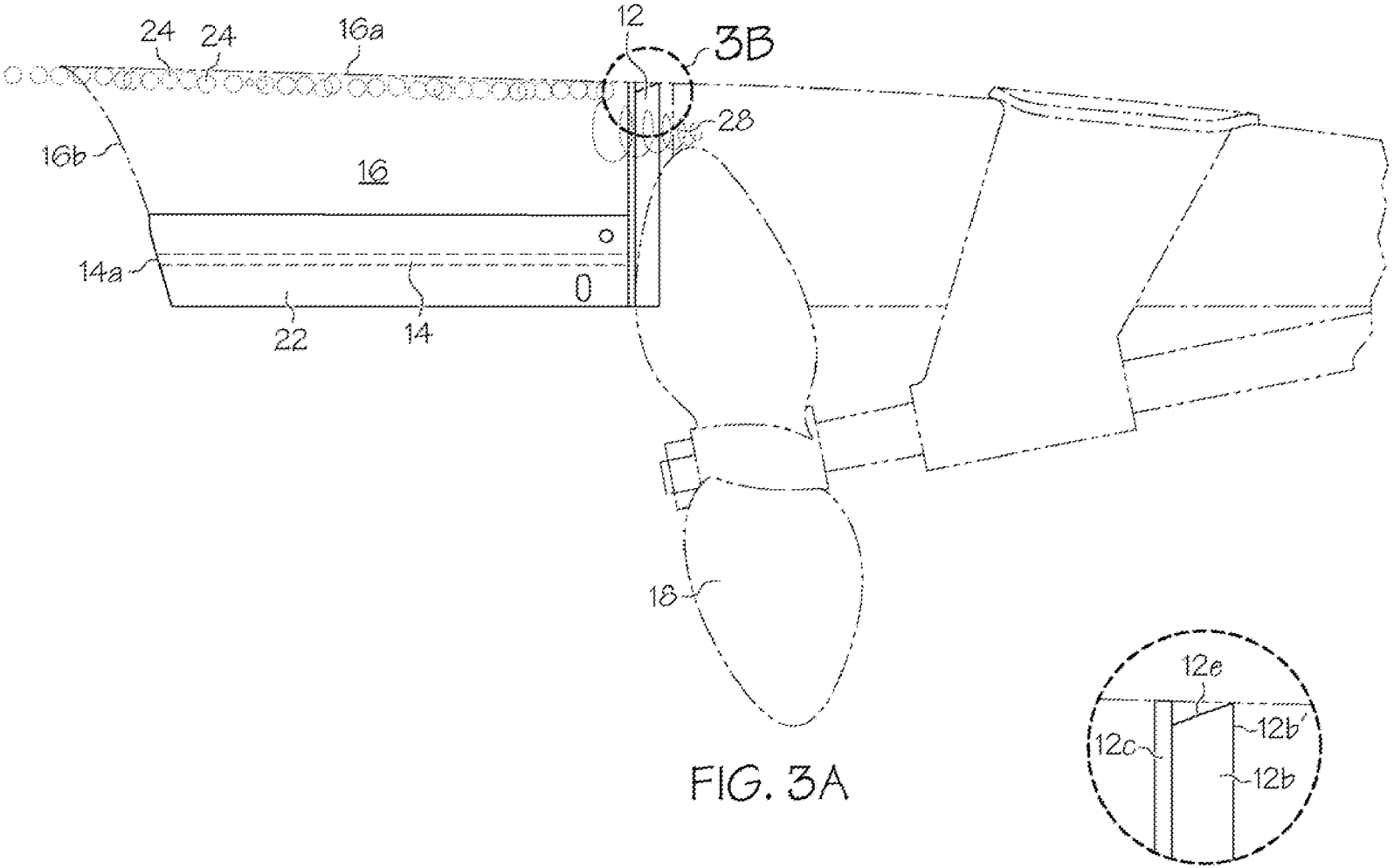
FIG. 3A shows a cross-sectional view of a tunnel and air induction system incorporating the instant invention.
FIG. 3B shows a cross-sectional, detailed view of the arcuate channel and flange of the wedge member.

The air induction system 10 as stated in this invention is a passive system developed to provide a uniform layer of compressible air, capable of absorbing the cavitation energy that is found in propeller tunnels. As illustrated in FIGS. 1-4, the passive air induction system 10 comprises an air distribution channel 12 and at least one air induction channel 14 in gaseous communication with the air distribution channel 12. In a primary embodiments, the air distribution channel constitutes a wedge member 12 that is preferably curved and generally semicircular in shape. As seen more particularly in FIG. 4, wedge member 12 includes a bottom surface 12*a*, a top surface 12*b*, and a flange 12*c* connected to and projecting at an angle upward from the lower surface of said wedge member. Preferably, the flange 12*c* is oriented perpendicularly with respect to a wall 16*a* of a boat propeller tunnel 16 that forms part of a boat hull bottom 20 of a vessel. As illustrated in FIG. 3B, the top surface 12*b* of the wedge member 12 includes a free end 12*b*' that is angled upward toward the wall 16*a* of the boat propeller tunnel 16 so as to form an arcuate channel 12*e* with the flange 12*c*. The free end 12*b*' of the wedge member top surface 12*b* may contact the wall 16*a* of the boat propeller tunnel 16.

The wedge member 12 also includes one or more air distribution orifices 12*d* for exhausting air from said wedge member around the periphery of the wall 16*a* of the boat propeller tunnel 16 aft of the propeller 18. As illustrated in FIGS. 1 and 2, the wedge member 12 is attached to a wall section 16*a* of the curvilinear boat propeller tunnel 16, which is incorporated as a section of the boat hull bottom 20. The wedge member 12 is shaped and sized for secure and complementary installation on the wall 16*a* of the boat propeller tunnel 16. The wedge member 12 may be an integral component of the boat hull, molded as unit in the manufacturing process. Alternatively, the wedge member may be attached to the wall 16*a* using any suitable hardware or fastener that is preferably corrosion-resistant and water-resistant or insoluble.

The distribution slots 12*d* of wedge member 12 comprise openings spaced evenly and at regular intervals about the edge of the flange 12*c* to provide air flow and entrained bubbles 24 around the arcuate periphery of the wall 16*a* of the boat propeller tunnel 16.

Although the primary embodiment of the air distribution channel is a wedge member as discussed herein, one skilled in the art would appreciate that the channel could be any cross-sectional geometric shape incorporated about the periphery of the propeller tunnel. The significant characteristic is that the channel is a conduit for gaseous introduction into the propeller tunnel when the vessel is operating at higher speeds or on plane. Similarly, in alternate embodiments of the passive air induction system 10, the distribution slots 12*d* may comprise any series of spaced orifices or apertures perforating the flange 12*c*. The shape and size of the orifices is also a matter of design choice.

Figure 4:
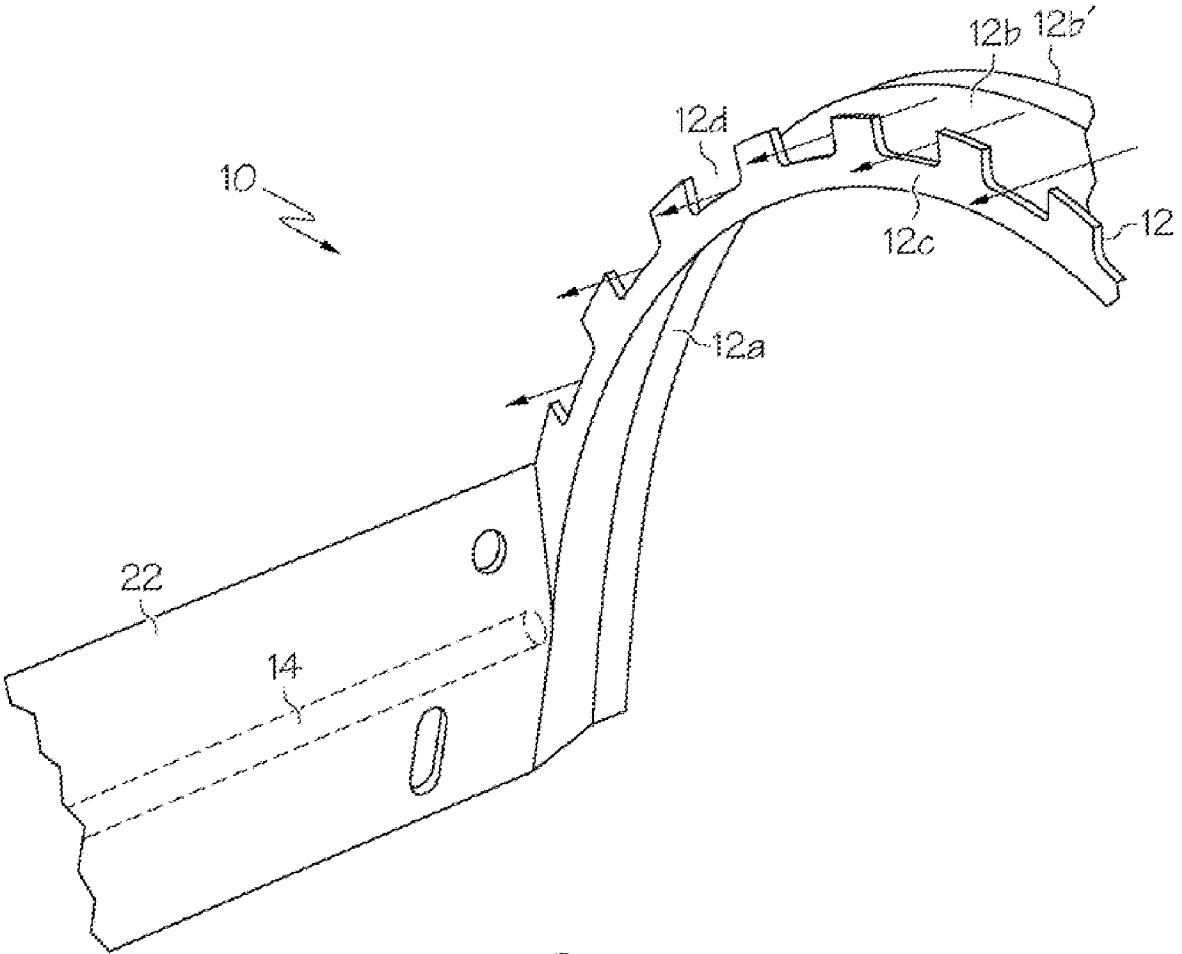
FIG. 4 shows a perspective and detailed view of the transition from induction tube to distribution slots.

As illustrated in FIGS. 1 and 4, the air induction channel can constitute a generally tubular member 14 which supplies ambient air entering through an air inlet 14*a* near the transom of the vessel to said distribution slots 12*d*. Preferably, the system 10 includes at least two air induction tubes 14, which run longitudinally from the transom 32 of the vessel at the stern end 16*b* of the boat propeller tunnel. The air induction tubes 14 may be integrally formed or molded within the hull and arm members 22 that connect to the wedge member 12 and extend aft of the wedge member. Air enters the air induction tubes 14 through the air inlets 14*a* and is carried or suctioned into the arcuate channel 12*e* of the wedge member 12, which forms part of a chamber or cavity 26 between the top surface 12*b* of the wedge member and the wall 16*a* of the boat propeller tunnel 16. Note also that arm members 22 running fore and aft can be "shelled" in the manufacturing process to the same wall thickness as wedge member 12, such that induction tubes 14 take the shape of the outside surfaces of members 22 with any appropriate offset inwardly to match that of wedge member 12.

In the preferred embodiment of the passive air induction system 10, the air induction tubes 14 and the wedge member 12 form a integrated system and unitary device. The system typically includes two air induction tubes 14 each of which is seated at opposite sides to the propeller tunnel, run generally longitudinally thereto, and are parallel to one another. However, it is contemplated that the air induction channels may run from other locations on the vessel, and the conduits need not be symmetrical. Similarly, although the channels 14 are depicted as generally tubular, they can be of any appropriate geometric shape and size for a particular vessel design.

During manufacturing, whether integrally with the hull molding process or installation as separate induction system, wedge member 12 is fitted and secured around the periphery of the propeller tunnel and aft of the propeller blade 18. The wedge member or channel 12 defines the cavity 26 between the top surface 12*b* of the wedge member and the uppermost wall 16*a* of the boat propeller tunnel 16. Ambient air received into the air inlets 14*a* of the air induction tubes 14 flows and is transported through the induction tubes and supplied into the distribution cavity 26 formed between the wedge member 12 and the wall 16*a* of the boat propeller tunnel 16. The air entering into the cavity 26 is then exhausted as air bubbles 24 through the distribution slots 12*d* of the wedge member 12. As shown in FIG. 3A, the air bubbles 24 form a boundary layer and cushion between the wall 16*a* of the boat propeller tunnel and cavitation vortices 28 created by rotation of the propeller 18, thereby reducing noise and vibration caused by implosion of the cavitation vortices on the boat propeller tunnel.

The inventions described herein also include a method for reducing noise and vibration caused by cavitation vortices 28 created by the rotation of a boat propeller 18 within a boat propeller tunnel 16 of a hull bottom 20. The method comprises the steps of installing a distribution member 12 to the hull bottom 20 within the boat propeller tunnel 16 aft of the propeller 18 and supplying air to an enclosed cavity 26 that is exhausted from the enclosed channel around the periphery of the wall of said boat propeller tunnel aft of the propeller. When installed within the vessel hull about the propeller tunnel, the distribution member 12 defines the space or cavity 26 which receives the air supplied by and through the air induction channels. The cavity is formed in part by the arcuate member 12*e*, perpendicular flange 12*c* of the wedge member 12 and a top surface 12*b* of the wedge member having end 12*b*' that is angled upward toward the wall 16*a* of the boat propeller tunnel 16. The air is exhausted through a plurality of distribution orifices 12*d* in the face of the distribution channel, causing air bubbles 24 to be released around the periphery of the walls of the propeller tunnel, thereby forming the protective cushion and boundary layer between the bottom of the hull and the deleterious cavitation vortices.

The high velocity water passing over wedge 12 creates a region of low pressure slightly aft of the distribution slots 12*d*, as shown in FIG. 3A. Ambient air from the atmospheric pressure region at the transom 32 of the vessel is sucked through air induction tubes 14 into the negative pressure region created when the boat is on plane. This air is then discharged back into the boat propeller tunnel 16 through the distribution slots 12*d* of the wedge member 12. The result of this discharge of air is the creation of a uniform layer of air that forms a cushion at the boat propeller tunnel surface or wall 16*a* and the stern end 16*b* of the boat propeller tunnel 16. This cushion, due to the compressibility of air, is capable of absorbing the cavitation energy and insolating the boat hull bottom 20 from the shock waves created by the implosion of the collapsing low pressure voids of the cavitation vortices 28. Testing of the system 10 has produced results showing extremely substantial reduction in vibration levels in the hull structure, exceeding 100%. The cushioning effect of these air bubbles 24 reduces or eliminates the noise and vibration normally caused by the implosion of the cavitation vortices within the boat propeller tunnel 16.

The instant description, drawings and artistic renditions illustrate to one of ordinary skill in the art, how to manufacture, assemble and utilize the instant passive air induction system 10 for marine vessels.

The instant invention has been shown and described herein in what is considered to be the most practical and preferred embodiment. It is recognized, however, that departures may be made therefrom within the scope of the invention and that obvious modification will occur to a person skilled in the art.

What is claimed is:

1. A passive air induction system for a marine vessel having a hull, propeller and propeller tunnel, to reduce noise and vibration caused by cavitation, said system comprising:

an air distribution channel member, said air distribution channel member having a plurality of exhaust orifices;

said air distribution channel member being positioned about the periphery of said propeller tunnel and aft of the location of said propeller;

said air distribution channel member generally constituting a wedge member, said wedge member being shaped and sized for secure and complementary installation about the external wall of said propeller tunnel;

wherein said wedge member is generally curved and semicircular in shape and includes a bottom surface, a top surface, and a flange connected to and projecting at an angle upward from the top surface of said wedge member;

wherein said exhaust orifices constitute a series of distribution slots perforating said flange;

at least one air induction channel member; said air induction channel member having an air inlet and providing air flow to said distribution channel member; and said air distribution channel member providing air to propeller tunnel through said exhaust orifices.

2. The system of claim 1, wherein said wedge member is arcuate and integrally formed within said vessel hull.

3. The system of claim 1, wherein said air induction channel member constitutes a tubular conduit which extends from the vessel transom to said air distribution channel member and is in gaseous communication therewith.

4. The system of claim 3, wherein said tubular conduit is integrally formed within said vessel hull.

5. The system of claim 1, wherein said air distribution channel member and said air induction channel member constitute a single-piece, unitary device.

6. The system of claim 1, wherein said wedge member, positioned about said vessel hull and propeller tunnel, defines a chamber between said top surface of said wedge member and said vessel hull.

7. The system of claim 6, wherein said air induction channel receives ambient air through said air inlet and supplies said ambient air into said chamber formed between said wedge member and said boat hull bottom to be exhausted through said distribution slots of said wedge member.

8. The system of claim 1, further comprising:

two air induction channels positioned on opposite sides of said propeller tunnel.

9. The system of claim 1, wherein said distribution slots are spaced evenly and at regular intervals through said flange to provide air bubbles around the curvilinear periphery and external wall of said boat propeller tunnel.

* * * * *